US006849229B2

(12) United States Patent
Ott et al.

(10) Patent No.: US 6,849,229 B2
(45) Date of Patent: Feb. 1, 2005

(54) PRODUCTION OF INJECTION-MOLDED METALLIC ARTICLES USING CHEMICALLY REDUCED NONMETALLIC PRECURSOR COMPOUNDS

(75) Inventors: Eric Allen Ott, Cincinnati, OH (US); Andrew Philip Woodfield, Cincinnati, OH (US); Clifford Earl Shamblen, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 21 days.

(21) Appl. No.: 10/329,176

(22) Filed: Dec. 23, 2002

(65) Prior Publication Data

US 2004/0120841 A1 Jun. 24, 2004

(51) Int. Cl.[7] ..... B22F 3/00

(52) U.S. Cl. ..... 419/36; 419/63; 419/65; 75/351; 75/369

(58) Field of Search ..... 419/36, 63, 65; 75/351, 369; 264/645

(56) References Cited

U.S. PATENT DOCUMENTS

| | | | | | |
|---|---|---|---|---|---|
| 4,383,852 | A | * | 5/1983 | Yoshizawa | 75/363 |
| 4,415,528 | A | * | 11/1983 | Wiech, Jr. | 419/46 |
| 4,519,839 | A | * | 5/1985 | Toyoaki et al. | 75/242 |
| 4,604,259 | A | * | 8/1986 | Whitman | 75/247 |
| 5,322,666 | A | | 6/1994 | Watwe | |
| 5,686,676 | A | * | 11/1997 | Jech et al. | 75/247 |
| 5,713,982 | A | * | 2/1998 | Clark et al. | 75/359 |
| 5,779,761 | A | | 7/1998 | Armstrong et al. | |
| 5,930,580 | A | | 7/1999 | Everett | |
| 5,958,106 | A | | 9/1999 | Armstrong et al. | |
| 5,989,493 | A | | 11/1999 | LaSalle et al. | |
| 6,036,742 | A | | 3/2000 | Leutner et al. | |
| 6,136,265 | A | * | 10/2000 | Gay | 419/35 |
| 6,562,290 | B2 | * | 5/2003 | Meinhardt et al. | 419/35 |
| 6,699,305 | B2 | * | 3/2004 | Myrick | 75/351 |
| 2002/0068005 | A1 | | 6/2002 | Bernd et al. | |
| 2003/0205108 | A1 | | 11/2003 | Moon-Hee et al. | |

FOREIGN PATENT DOCUMENTS

| | | |
|---|---|---|
| JP | 01 184203 A | 10/1989 |
| WO | WO 99/64638 | 12/1999 |
| WO | WO 9964638 | 12/1999 |

* cited by examiner

*Primary Examiner*—Ngoclan T. Mai
(74) *Attorney, Agent, or Firm*—McNees Wallace & Nurick LLC

(57) ABSTRACT

A method of preparing an article made of a metallic material having its constituent elements includes the steps of furnishing at least one nonmetallic precursor compound, wherein all of the nonmetallic precursor compounds collectively include the constituent elements of the metallic material in their respective constituent-element proportions, and thereafter utilizing the nonmetallic precursor compound to produce a metallic injection molded brown article. The nonmetallic precursor compounds may be processed into the metallic material by first chemically reducing them to the metallic material, and then injection molding the metallic material, or first injection molding the nonmetallic precursor compounds and then chemically reducing them to the metallic material.

19 Claims, 3 Drawing Sheets

PRODUCTION OF INJECTION-MOLDED METALLIC ARTICLES USING CHEMICALLY REDUCED NONMETALLIC PRECURSOR COMPOUNDS

This invention relates to the production of injection-molded articles and, more particularly, to such articles prepared without melting the constituents or the injection-molded article.

BACKGROUND OF THE INVENTION

Injection molding (IM) is an approach for fabricating articles from powders of the constituents. In injection molding, powder particles are mixed with a binder and usually other constituents, such as a lubricant, so as to make a flowable feedstock mixture. The feedstock mixture is injected into a mold under pressure using an injection-molding machine similar to those used to injection mold plastics. The injected mass, termed a "green" article, is removed from the mold. Most of the constituents of the green article other than the particles, and specifically the binder and lubricant, are largely removed from the green article by a suitable process such as heating to vaporize the ingredients or solvent extraction, leaving a relatively fragile body termed a "brown" article that has the molded shape but little mechanical strength. This terminology of "green" article and "brown" article is widely used in the industry and is also utilized herein. The brown article is then consolidated, typically by sintering, to produce the final article.

In one variety of injection molding, the particles are of a metallic alloy, and the process is termed metal injection molding (MIM). In MIM, gas-atomized or water-atomized metal alloy powder is mixed with the binder and other constituents to make the feedstock. The resulting article is formed of the metallic alloy.

Articles may be produced by MIM to precise dimensional tolerances. The green article is oversize, and then shrinks during the subsequent process steps to the required dimensions of the final article. The shrinkage is predictable, so that MIM may be used to make complex metal alloy articles to precise dimensional requirements. Articles produced by MIM are typically not used for demanding applications requiring high mechanical properties, because there is typically some porosity left in the article after sintering.

Injection molding generally and MIM specifically are widely used, but there is a need to modify its current approach to improve the properties of the final article and reduce the cost of the final article. The present invention fulfills this need, and further provides related advantages.

SUMMARY OF THE INVENTION

The present approach provides a method for preparing a metallic alloy article by injection molding (IM). The approach produces a final injection-molded article of controllable composition and structure, improves the properties of the final article, as well as reducing its cost.

A method of preparing an article comprising a metallic material having its constituent elements comprises the steps of furnishing at least one nonmetallic precursor compound, wherein all of the nonmetallic precursor compounds collectively include the constituent elements of the metallic material in their respective constituent-element proportions. The nonmetallic precursor compound is thereafter utilized to produce a metallic injection molded brown article, without melting the nonmetallic precursor compound and without melting the brown article.

The result of the injection molding operation is a metallic brown article, which is then compacted, preferably by sintering, to make a metallic alloy part. The sintering is preferably performed in the solid state, rather than liquid-phase sintering. The result is a metallic alloy article whose metallic alloy has not been melted during its fabrication.

In a first specific embodiment of the method, the step of utilizing includes the steps of chemically reducing the nonmetallic precursor compound to produce particles comprising the metallic material, without melting the nonmetallic precursor compound and without melting the metallic material, and thereafter injection molding the particles of the metallic material to produce the brown article comprising the particles of the metallic material, without melting the metallic material. In a second specific embodiment, the step of utilizing includes the steps of injection molding the nonmetallic precursor compound to form a body comprising the nonmetallic precursor compound, and thereafter chemically reducing the nonmetallic precursor compound to produce the brown article comprising the metallic material, without melting the nonmetallic precursor compound and without melting the metallic material.

Thus, in the first embodiment, the nonmetallic precursor compounds are first chemically reduced to produce particles of the metallic material, and then the metallic particles are injection molded to produce the brown metallic article. In the second approach, the nonmetallic precursor compounds are injection molded to form a nonmetallic body, and then the nonmetallic precursor compounds are chemically reduced to produce the brown metallic article. In each embodiment, the brown article is then sintered.

The metallic material may be of any operable composition, such as, for example, a nickel-base material, an iron-base material, a cobalt-base material, or a titanium-base material. The particles are of any operable shape and size, but are preferably non-spherical particles. The chemical reduction may be by any operable approach, but is preferably by solid-phase reduction or by vapor-phase reduction.

In the usual case, the step of injection molding includes the steps of mixing the particles of the particulate material to be injection molded with a binder and usually a lubricant to form a particle-binder feedstock mixture, injecting the feedstock mixture into a mold to form a green article, removing the green article from the mold, and debinding the green article to form the brown article. A wide variety of modifications to the basic IM process, known in the art, may be used in relation to the present approach.

The present approach utilizes metal particles that are produced by the chemical reduction of nonmetallic precursor compounds. The metal particles are not melted, but instead are produced directly from the gaseous or solid precursor compounds. The production cost of the final metallic article is reduced. The particles are generally approximately equiaxed but roughly and irregularly shaped, and are also somewhat spongelike and porous. These particles achieve good packing during the injection molding. The debinding efficiency in removing the binder and other additives is enhanced. Sintering kinetics is improved through the use of these particles.

The meltless fabrication approach for the particles allows the composition of the metallic final article to be controlled more precisely than with melt-based approaches, and also allows compositions to be produced that cannot be prepared by melting. The chemistry control is also better because the presence of undesirable impurity elements and desirable dopants may be controlled very precisely. Additionally, the use of the meltless fabrication technique for the powder reduces the potential contamination of the powder from oxides, dross, and crucible materials, as compared with the conventional approach, leading to a higher quality of the final product.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
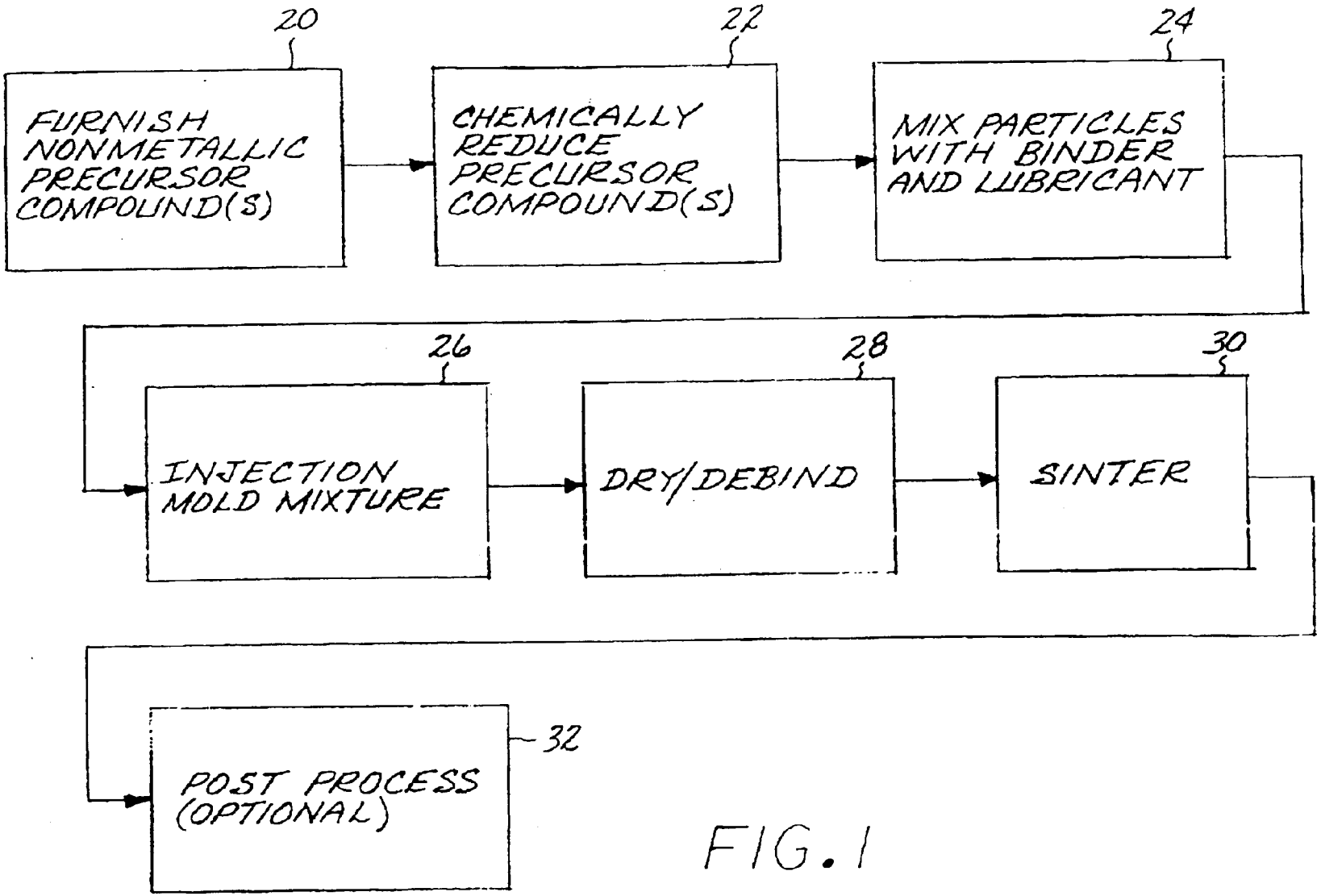
FIG. 1 is a block flow diagram of a first embodiment of the present approach.

FIG. 1 is a block flow diagram illustrating a first preferred method for preparing an article comprising a metallic material having its constituent elements. At least one nonmetallic precursor compound is furnished, step 20. All of the nonmetallic precursor compounds collectively include the constituent elements of the metallic material in their respective constituent-element proportions. The constituent elements may be supplied by the nonmetallic precursor compounds in any operable way. In the preferred approach, there is exactly one non-oxide precursor compound for each alloying element, and that one precursor compound provides all of the material for that respective metallic constituent in the alloy. For example, for a four-element metallic material that is the final result of the process, a first precursor compound supplies all of the first element, a second precursor compound supplies all of the second element, a third precursor compound supplies all of the third element, and a fourth precursor compound supplies all of the fourth element. Alternatives are within the scope of the approach, however. For example, several of the precursor compounds may together supply all of one particular metallic element. In another alternative, one precursor compound may supply all or part of two or more of the metallic elements. The latter approaches are less preferred, because they make more difficult the precise determination of the elemental proportions in the final metallic material. The final metallic material is typically not a stoichiometric compound, having relative amounts of the metallic constituents that may be expressed as small integers.

The metallic material and its constituent elements comprise any operable type of alloy. Examples include a nickel-base material, an iron-base material, a cobalt-base material, and a titanium-base material. An "X-base" alloy has more of element X by weight than any other element. Some specific examples of metallic alloy types and compositions that may be made by the present approach include articles made of titanium-6 aluminum-4 vanadium, Hastelloy X, 17-4 precipitation hardening steel, and 304 stainless steel, although the use of the invention is not limited to these materials.

The nonmetallic precursor compounds are selected to be operable in the reduction process in which they are reduced to metallic form. In one reduction process of interest, solid-phase reduction, the precursor compounds are preferably metal oxides. In another reduction process of interest, vapor-phase reduction, the precursor compounds are preferably metal halides. Mixtures of different types of nonmetallic precursor compounds may be used, as long as they operable in the subsequent chemical reduction.

The nonmetallic precursor compounds are selected to provide the necessary metals in the final article, and are mixed together in the proper proportions to yield the necessary proportions of these metals in the article. For example, if the metallic material were to have particular proportions of titanium, aluminum, and vanadium in the ratio of 90:6:4 by weight, the nonmetallic precursor compounds are preferably titanium oxide, aluminum oxide, and vanadium oxide for solid-phase reduction, or titanium tetrachloride, aluminum chloride, and vanadium chloride for vapor-phase reduction. Nonmetallic precursor compounds that serve as a source of more than one of the metals in the final article may also be used. These precursor compounds are furnished and mixed together in the correct proportions such that the ratio of titanium:aluminum:vanadium in the mixture of precursor compounds is that required to form the metallic material in the final article (90:6:4 by weight in the example).

The precursor compound or compounds are chemically reduced (i.e., the opposite of chemical oxidation) to produce particles comprising the metallic material, step 22, without melting the precursor compounds and without melting the metallic material. As used herein, "without melting", "no melting", and related concepts mean that the material is not macroscopically or grossly melted for an extended period of time, so that it liquefies and loses its shape. There may be, for example, some minor amount of localized melting as low melting-point elements melt and are diffusionally alloyed with the higher-melting-point elements that do not melt, or very brief melting for less than about 10 seconds. Even in such cases, the gross shape of the material remains unchanged.

In one preferred chemical reduction approach, termed vapor-phase reduction because the nonmetallic precursor compounds are furnished as vapors or gaseous phase, the chemical reduction may be performed by reducing mixtures of halides of the base metal and the alloying elements using a liquid alkali metal or a liquid alkaline earth metal. For example, titanium tetrachloride and the halides of the alloying elements are provided as gases. A mixture of these gases in appropriate amounts is contacted to molten sodium, so that the metallic halides are reduced to the metallic form. The metallic alloy is separated from the sodium. This reduction is performed at temperatures below the melting point of the metallic alloy. The approach is described more fully in U.S. Pat. Nos. 5,779,761 and 5,958,106, whose disclosures are incorporated by reference.

Reduction at lower temperatures rather than higher temperatures is preferred. Desirably, the reduction is performed at temperatures of 600° C. or lower, and preferably 500° C. or lower. By comparison, prior approaches for preparing titanium- and other metallic alloys often reach temperatures of 900° C. or greater, and usually temperatures above the melting points of the alloys. The lower-temperature reduction is more controllable, and also is less subject to the introduction of contamination into the metallic alloy, which contamination in turn may lead to chemical defects. Additionally, the lower temperatures reduce the incidence of sintering together of the particles during the reduction step.

In this vapor-phase reduction approach, a nonmetallic modifying element or compound presented in a gaseous form may be mixed into the gaseous nonmetallic precursor compound prior to its reaction with the liquid alkali metal or the liquid alkaline earth metal. In one example, oxygen or nitrogen may be mixed with the gaseous nonmetallic precursor compound(s) to increase the level of oxygen or nitrogen, respectively, in the initial metallic material. It is sometimes desirable, for example, that the oxygen content of the initial metallic particle and the final metallic article be about 1200–2000 parts per million by weight to strengthen the final metallic article or to provide oxygen that is used in forming a dispersoid. Rather than adding the oxygen in the form of solid titanium dioxide powder, as is sometimes practiced for titanium-base alloys produced by conventional melting techniques, the oxygen is added in a gaseous form that facilitates mixing and minimizes the likelihood of the formation of hard alpha phase in the final article. When the oxygen is added in the form of titanium dioxide powder in conventional melting practice, agglomerations of the powder may not dissolve fully, leaving fine particles in the final metallic article that constitute chemical defects. The present approach avoids that possibility.

In another reduction approach, termed solid-phase reduction because the nonmetallic precursor compounds are furnished as solids, the chemical reduction may be performed by fused salt electrolysis. Fused salt electrolysis is a known technique that is described, for example, in published patent application WO 99/64638, whose disclosure is incorporated by reference in its entirety. Briefly, in fused salt electrolysis the mixture of nonmetallic precursor compounds, furnished in a finely divided or precompacted solid form, is immersed in an electrolysis cell in a fused salt electrolyte such as a chloride salt at a temperature below the melting temperature of the metallic alloy that is formed from the nonmetallic precursor compounds. The mixture of nonmetallic precursor compounds is made the cathode of the electrolysis cell, with an inert anode. The elements combined with the metals in the nonmetallic precursor compounds, such as oxygen in the preferred case of oxide nonmetallic precursor compounds, are partially or completely removed from the mixture by chemical reduction (i.e., the reverse of chemical oxidation). The reaction is performed at an elevated temperature to accelerate the diffusion of the oxygen or other gas away from the cathode. The cathodic potential is controlled to ensure that the reduction of the nonmetallic precursor compounds will occur, rather than other possible chemical reactions such as the decomposition of the molten salt. The electrolyte is a salt, preferably a salt that is more stable than the equivalent salt of the metals being refined and ideally very stable to remove the oxygen or other gas to a desired low level. The chlorides and mixtures of chlorides of barium, calcium, cesium, lithium, strontium, and yttrium are preferred. The chemical reduction is preferably, but not necessarily, carried to completion, so that the nonmetallic precursor compounds are completely reduced. Not carrying the process to completion is a method to control the oxygen content of the metal produced.

In another reduction approach, termed "rapid plasma quench" reduction, the nonmetallic precursor compound such as titanium chloride is dissociated in a plasma arc at a temperature of over 4500° C. The nonmetallic precursor compound is rapidly heated, dissociated, and quenched in hydrogen gas. The result is fine metal-hydride particles. Any melting of the metallic particles is very brief, on the order of 10 seconds or less, and is within the scope of "without melting" and the like as used herein. The metal-hydride particles are thereafter reduced in a vacuum to form metallic particles.

The result of the chemical reduction step 22 is a plurality of particles, with each particle comprising the metallic material. These particles are made without melting of the precursor compound(s) or of the metallic material. The particles have low contents of impurities, such as metallic impurities, ceramic impurities, oxides, and the like, that result from conventional melting operations, unless oxygen is intentionally introduced to produce a high oxide content.

The particles exhibit a narrow size distribution, so that little screening or other size-classification processing is necessary to produce a particle mass suitable for the subsequent processing operations. As a result, the processing costs are reduced, both by reducing the amount of size-classification processing and also because the yield of particles is higher than in other particle-production approaches.

The particles of the metallic material are metal injection molded, steps 24–28, to produce a brown article comprising the particles of the metallic material, without melting the metallic material. Any operable metal injection molding technique may be used. In a preferred approach, the particles of the metallic material are first mixed with a binder to form a particle-binder feedstock mixture, step 24. The binder may be an organic material, such as paraffin wax or methyl cellulose. Other ingredients may optionally be mixed with the binder and particles, such as a lubricant or a sintering aid.

The particle-binder mixture is injected into a mold to form a green article, step 26. The interior shape of the mold defines the shape of the article to be produced, but the interior dimensions and thence the green article are typically significantly oversize to allow for subsequent shrinkage. The green article is removed from the mold after the binder has set. The green article is thereafter dried and debinded to form the brown article, step 28. Most of the binder (and constituents such as lubricants other than the particles) are removed by any operable approach, resulting in the brown article. In one approach, the green article is heated to a temperature at which the binder vaporizes. In another approach, the binder is removed by dissolution or solvent extraction. Sufficient binder remains that the brown article retains its shape and may be handled carefully in preparation for the next step.

The brown article is thereafter consolidated by any operable approach. Most preferably, the brown article is sintered, step 30, at a temperature sufficiently high to cause the particles to shrink together and bond together, and to cause the remainder of the binder and other additives to evaporate. The sintering is preferably solid state sintering, so that the particles and the final article are not melted during the sintering operation. The sintering conditions are selected to be compatible with the composition of the metallic material. During the debinding and the sintering steps the dimensions of the brown article shrink substantially to their final values, unless there is further subsequent machining.

Optionally, the sintered article is post processed, step 32. Post processing may include any further operations, such as heat treating, machining, cleaning, coating, and the like. These post processing operations are selected according to the material of construction of the sintered article and the specific application of the sintered article.

Figure 2:
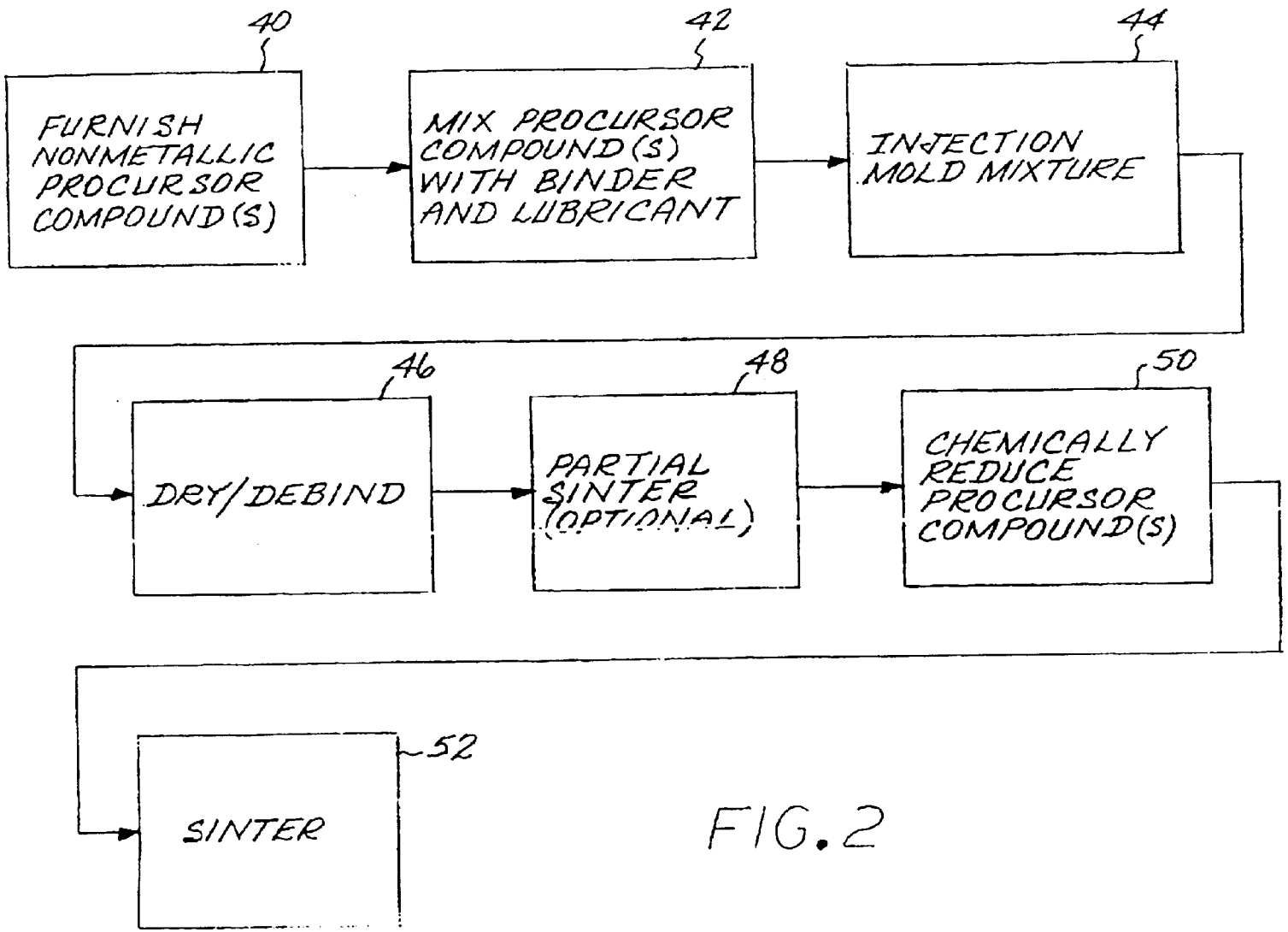
FIG. 2 is a block flow diagram of a second embodiment of the present approach.

FIG. 2 illustrates a second preferred embodiment of the method. The nonmetallic precursor compound or compounds are furnished, step 40, in a solid particulate form. The prior description associated with step 20 is incorporated here, except that the nonmetallic precursor compounds may not be gaseous. The precursor compound or compounds are mixed with the binder and lubricant, step 42, the mixture is injected into the mold, step 44, and the injection molded article is dried and debinded, step 46. The prior discussion of respective steps 24, 26, and 28 is incorporated as to steps 42, 44, and 46. The resulting brown article is nonmetallic in nature, however, as distinct from the metallic green article that results from step 28 in the embodiment of FIG. 1.

The brown article may be partially sintered, step 48, to improve its strength without removing the porosity substantially. The sintering is similar to that described in step 30 of FIG. 1, whose description is incorporated, except that the sintering is performed to achieve a less-than-100 percent-dense article. The objective of this step 48 is to improve the strength of the article to permit easier handling, but not to close the porosity that allows the chemical reduction to proceed efficiently.

The nonmetallic precursor compounds are thereafter chemically reduced, step 50. The prior description of step 22 is incorporated here, except that the chemical reduction may only be accomplished by solid-phase reduction because the nonmetallic precursor compounds are necessarily solid particles. The result is that the nonmetallic precursor compounds are reduced to the metallic state.

The now-metallic brown article is thereafter sintered, step 52. The prior description of step 30 is incorporated here as to step 52.

The approaches of FIGS. 1 and 2 provide two paths from nonmetallic precursor compounds to the final metallic article. The precursor compounds and the metallic alloy are not melted in either approach. The embodiment of FIG. 1 has the characteristics of metal injection molding because the powders that are injected molded in step 26 are metallic. In the embodiment of FIG. 2, however, the process is not metal injection molding, because the powders that are injected molded in step 44 are not metallic, but are the nonmetallic precursor compounds. In each case, however, the final article is metallic and is not melted during its fabrication.

Figure 3:
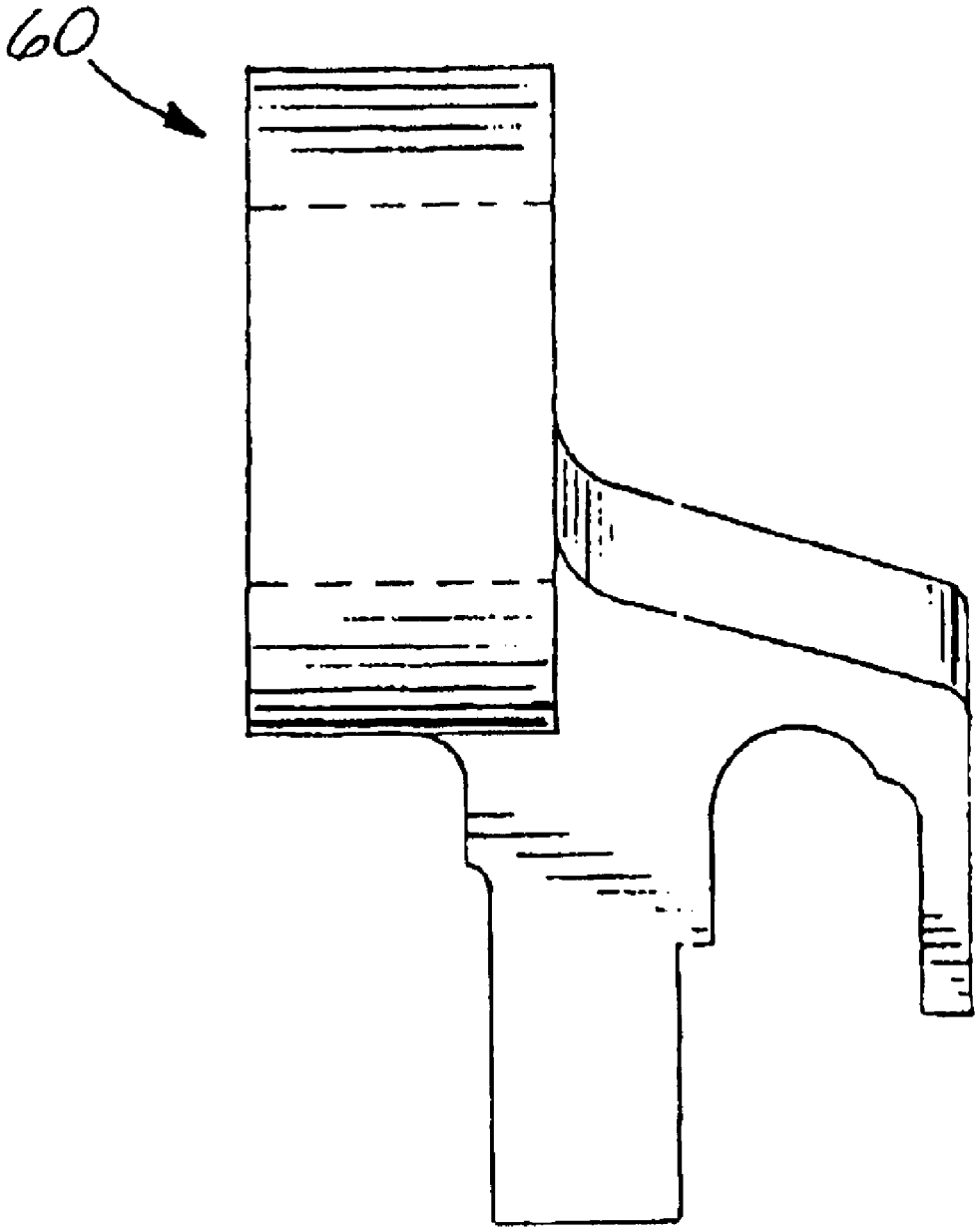
FIG. 3 is an elevational view of an article prepared using the present approach.

FIG. 3 illustrates an example of an article 40 that is prepared by the present approach. In this case, the article 40 is a bearing housing. It is desirable in this case that the article have a degree of porosity so that a bearing lubricant may be infiltrated into the bearing housing. However, this article is an example only, and the use of the present invention is not so limited. Other examples of metallic articles that are components used in aircraft gas turbine engines include stator vanes and brackets. The amount of porosity in the final article may be controlled by the extent of the sintering, so that a range of porosities may be obtained as desired.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

What is claimed is:

1. A method of preparing an article comprising a metallic alloy material having its constituent elements, comprising the steps of furnishing at least one nonmetallic precursor compound, wherein all of the nonmetallic precursor compounds collectively include the constituent elements of the metallic alloy material in their respective constituent-element proportions; and thereafter utilizing the nonmetallic precursor compound to produce a metallic alloy injection molded brown article, without melting the metallic alloy material and without melting the brown article.

2. The method of claim 1, wherein the step of utilizing includes the steps of chemically reducing the nonmetallic precursor compound to produce particles comprising the metallic alloy material, without melting the metallic alloy material, and thereafter injection molding the particles of the metallic alloy material to produce the brown article comprising the particles of the metallic alloy material, without melting the metallic alloy material.

3. The method of claim 1, wherein the step of utilizing includes the steps of injection molding the nonmetallic precursor compound to form a body comprising the nonmetallic precursor compound, and thereafter chemically reducing the nonmetallic precursor compound to produce the brown article comprising the metallic alloy material, without melting the metallic alloy material.

4. The method of claim 1, including an additional step, after the step of utilizing, of sintering the brown article.

5. A method of preparing an article comprising a metallic alloy material having its constituent elements, comprising the steps of furnishing at least one nonmetallic precursor compound, wherein all of the nonmetallic precursor compounds collectively include the constituent elements of the metallic alloy material in their respective constituent-element proportions; thereafter chemically reducing the nonmetallic precursor compound to produce particles comprising the metallic alloy material, without melting the metallic alloy material; and thereafter injection molding the particles of the metallic alloy material to produce a brown article comprising the particles of the metallic alloy material, without melting the metallic alloy material.

6. The method of claim 5, wherein the step of chemically reducing includes the step of producing spongelike particles.

7. The method of claim 5, wherein the step of chemically reducing includes the step of chemically reducing the nonmetallic precursor compounds by solid-phase reduction.

8. The method of claim 5, wherein the step of chemically reducing includes the step of chemically reducing the nonmetallic precursor compounds by vapor-phase reduction.

9. The method of claim 5, wherein the step of injection molding includes the steps of mixing the particles of the metallic alloy material with a binder to form a particle-binder mixture, injecting the particle-binder mixture into a mold to form a green article, removing the green article from the mold, and debinding the green article to form the brown article.

10. The method of claim 5, including an additional step, after the step of metal-injection molding, of sintering the brown article.

11. A method of preparing an article comprising a metallic alloy material having its constituent elements, comprising the steps of furnishing at least one nonmetallic precursor compound, wherein all of the nonmetallic precursor compounds collectively include the constituent elements of the metallic alloy material in their respective constituent-element proportions; thereafter injection molding the nonmetallic precursor compound to form a body comprising the nonmetallic precursor compound, and thereafter chemically reducing the nonmetallic precursor compound in the body to produce a brown article comprising the metallic alloy material, without melting the metallic alloy material.

12. The method of claim 11, wherein the step of chemically reducing includes the step of producing spongelike particles.

13. The method of claim 11, wherein the step of chemically reducing includes the step of producing the metallic alloy material selected from the group consisting of a nickel-base material, an iron-base material, a cobalt-base material, and a titanium-base material.

14. The method of claim 11, wherein the step of chemically reducing includes the step of chemically reducing the nonmetallic precursor compound by solid-phase reduction.

15. The method of claim 11, wherein the step of injection molding includes the steps of mixing the nonmetallic precursor compound with a binder to form a nonmetallic precursor compound-binder mixture, injecting the nonmetallic precursor compound-binder mixture into a mold to form a green article, removing the green article from the mold, and debinding the green article to form the brown article.

16. The method of claim 11, including an additional step, after the step of metal-injection molding, of sintering the brown article.

17. The method of claim 1, wherein the step of furnishing includes the step of furnishing the at least one precursor compound of the metallic alloy material selected from the group consisting of a nickel-base metallic alloy, a cobalt-base metallic alloy, and a titanium-base metallic alloy.

18. The method of claim 5, wherein the step of furnishing includes the step of furnishing the at least one precursor compound of the metallic alloy material selected from the group consisting of a nickel-base metallic alloy, a cobalt-base metallic alloy, and a titanium-base metallic alloy.

19. The method of claim 11, wherein the step of furnishing includes the step of furnishing the at least one precursor compound of the metallic alloy material selected from the group consisting of a nickel-base metallic alloy, a cobalt-base metallic alloy, and a titanium-base metallic alloy.

* * * * *